US008912869B2

(12) United States Patent
Horii et al.

(10) Patent No.: US 8,912,869 B2
(45) Date of Patent: Dec. 16, 2014

(54) ELECTROMAGNETIC RELAY

(71) Applicant: Panasonic Corporation, Osaka (JP)

(72) Inventors: Kazuhiko Horii, Hokkaido (JP); Junichi Watanabe, Osaka (JP); Naoki Muro, Nara (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/896,758

(22) Filed: May 17, 2013

(65) Prior Publication Data

US 2013/0249657 A1 Sep. 26, 2013

Related U.S. Application Data

(63) Continuation of application No. 13/379,672, filed as application No. PCT/JP2010/060392 on Jun. 18, 2010, now Pat. No. 8,471,656.

(30) Foreign Application Priority Data

| | | |
|---|---|---|
| Jun. 23, 2009 | (JP) | 2009-149159 |
| Jul. 7, 2009 | (JP) | 2009-160772 |
| Dec. 10, 2009 | (JP) | 2009-280816 |

(51) Int. Cl.

| | |
|---|---|
| ***H01H 51/22*** | (2006.01) |
| ***H01H 50/04*** | (2006.01) |
| *H01H 50/12* | (2006.01) |
| *H01H 50/02* | (2006.01) |

(52) U.S. Cl.

CPC ..... *H01H 50/04* (2013.01); *H01H 50/12* (2013.01); *H01H 50/043* (2013.01); *H01H 50/023* (2013.01)

USPC ..... 335/78

(58) Field of Classification Search

USPC ..... 335/78

See application file for complete search history.

(56) References Cited

U.S. PATENT DOCUMENTS

| | | | | |
|---|---|---|---|---|
| 4,587,502 | A * | 5/1986 | Matsuo et al. | 335/85 |
| 4,695,813 | A * | 9/1987 | Nobutoki et al. | 335/78 |
| 4,731,597 | A * | 3/1988 | Hinrichs | 335/128 |

(Continued)

FOREIGN PATENT DOCUMENTS

| | | |
|---|---|---|
| EP | 0331134 | 9/1989 |
| EP | 1821327 | 8/2007 |

(Continued)

OTHER PUBLICATIONS

Search report from E.P.O., mail date is Aug. 8, 2014.

*Primary Examiner* — Alexander Talpalatski

(74) *Attorney, Agent, or Firm* — Greenblum & Bernstein, P.L.C.

(57) ABSTRACT

An electromagnetic relay includes a bobbin including a winding part, jaw parts extending from both ends of the winding part, and a pair of opposing side wall parts; a coil wound on the winding part; an iron core attached to the bobbin; an armature; a movable contact which contacts or is separated from a fixed contact; and a case. The jaw part is formed to extend to a part in the vicinity of a side wall of the case so as to separate a first space where the coil exists from a second space where the fixed contact and the movable contact exist. Each of the side wall parts extends from the jaw part along an axis of the bobbin in a direction toward the second space and has a distal end abutting on the case.

11 Claims, 17 Drawing Sheets

(56) References Cited

U.S. PATENT DOCUMENTS

| | | | | |
|---|---|---|---|---|
| 4,740,769 | A * | 4/1988 | Mitschik | 335/83 |
| 5,148,136 | A * | 9/1992 | Kidd | 335/78 |
| 5,289,144 | A * | 2/1994 | Liao | 335/78 |
| 5,696,475 | A * | 12/1997 | Yoshitani et al. | 335/78 |
| 5,757,255 | A * | 5/1998 | Noda et al. | 335/78 |
| 5,880,654 | A * | 3/1999 | Yamaguchi et al. | 335/78 |
| 5,894,253 | A * | 4/1999 | Ichikawa et al. | 335/78 |
| 5,969,586 | A * | 10/1999 | Noda et al. | 335/83 |
| 6,225,880 | B1 * | 5/2001 | Kern | 335/78 |
| 6,232,858 | B1 * | 5/2001 | Reiter | 335/80 |
| 6,483,407 | B1 * | 11/2002 | Matsuda et al. | 335/78 |
| 6,590,480 | B2 * | 7/2003 | Matsuda | 335/78 |
| 6,670,871 | B1 * | 12/2003 | Saso et al. | 335/78 |
| 6,750,744 | B2 * | 6/2004 | Misumi et al. | 335/78 |
| 6,784,773 | B2 * | 8/2004 | Tsutsui et al. | 335/78 |
| 6,903,638 | B2 * | 6/2005 | Nakamura et al. | 335/78 |
| 6,924,719 | B2 * | 8/2005 | Saruwatari et al. | 335/78 |
| 7,283,026 | B2 * | 10/2007 | Nakamura et al. | 335/78 |
| 7,420,448 | B2 * | 9/2008 | Takeda et al. | 335/78 |
| 7,504,915 | B2 * | 3/2009 | Takayama et al. | 335/78 |
| 7,573,360 | B2 * | 8/2009 | Bryan et al. | 335/201 |
| 7,750,769 | B2 * | 7/2010 | Minowa et al. | 335/78 |
| 8,456,268 | B2 * | 6/2013 | Song | 336/192 |
| 2002/0036556 | A1 * | 3/2002 | Matsuda | 335/78 |
| 2003/0052759 | A1 * | 3/2003 | Misumi et al. | 335/78 |
| 2005/0057332 | A1 * | 3/2005 | Nakamura et al. | 335/128 |
| 2007/0194866 | A1 | 8/2007 | Miki | |

FOREIGN PATENT DOCUMENTS

| | | |
|---|---|---|
| JP | 60-73149 | 5/1985 |
| JP | 63-134436 | 9/1988 |
| JP | 3-127753 | 12/1991 |
| JP | 08-007736 | 1/1996 |
| JP | 9-92115 | 4/1997 |
| JP | 2002-245916 | 8/2002 |
| JP | 2003-31095 | 1/2003 |
| JP | 2004-158381 | 6/2004 |
| JP | 2007-323883 | 12/2007 |

* cited by examiner

ELECTROMAGNETIC RELAY

CROSS-REFERENCED RELATED APPLICATIONS

The present application is a continuation of U.S. application Ser. No. 13/379,672, filed Dec. 21, 2011, which is a National Stage Application of PCT/JP2010/060392, filed Jun. 18, 2010, the disclosures of which incorporated herein by reference in their entireties.

TECHNICAL FIELD

The present invention relates to an electromagnetic relay.

BACKGROUND ART

Usually, as the electromagnetic relay, there is provided an electromagnetic relay that includes: an electromagnet block having a coil bobbin having an iron core inserted into an axis and a coil wound and a yoke forming a magnetic circuit together with the iron core; a contact block including a fixed contact and a movable contact which freely contacts and is separated from the fixed contact in accordance with an operation of turning on/off an electric current to the coil; and a substantially rectangular box shaped case that accommodates the electromagnet block and the contact block therein, wherein a coil terminal connected to the coil of the electromagnet block and a fixed contact terminal and a movable contact terminal respectively connected to the fixed contact and the movable contact of the contact block protrude from a bottom surface of the case. In the above-described electromagnetic relay, there is a fear that when air in the periphery of the coil heated by the heat generation of the coil reaches a contact part including the movable contact and the fixed contact whose temperature is lower than that of other parts in the case so that vapor condensation occurs in the contact part and the temperature of the contact part falls to a freezing point or lower, condensate may possibly freeze to generate a failure of electric conduction.

Thus, in order to prevent the failure of electric conduction, for instance, Patent Document 1 discloses an electromagnetic relay in which a metal plate high in its thermal conductivity is allowed to come into indirect contact with a bottom surface of a case to generate a vapor condensation in an inner surface side of the case of the metal plate to reduce an amount of water included in the air of the case and suppress the occurrence of the vapor condensation in a contact part.

Further, as an electromagnetic relay meeting not to generate a freeze in a sealed case, for instance, Patent Document 2 disclosed an electromagnetic relay. In the electromagnetic relay disclosed in Patent Document 2, in an inner bottom part of a case, a shield wall is provided that interrupts air flowing toward a fixed contact and a movable contact to prevent the fixed contact and the movable contact from freezing.

RELATED ART DOCUMENTS

Patent Documents

Patent Document 1: JP-A-2003-31095
Patent Document 2: JP-A-2007-323883

SUMMARY OF THE INVENTION

Problem to be Solved by the Invention

However, in the usual example disclosed in Patent Document 1, since the metal plate which changes moisture to a vapor condensation and the contact part are provided in the same space, when the usual example is used by changing a direction such as an upper part and a lower part, there is a fear that water changed to the vapor condensation by the metal plate may possibly move to reach the contact part. Further, in the above-described usual example, since a temperature difference arises between the contact part and air in the periphery thereof, when humidity is high, the vapor condensation may be generated. In these cases, further, when the temperature of the contact part is a freezing point or lower, there is a fear that the condensate of the contact part may possibly freeze to cause a failure of electric conduction to occur.

Further, the electromagnetic relay disclosed in Patent Document 2 interrupts only the air flowing along the inner bottom part of the case, and does not meet a convection current flowing to the fixed contact and the movable contact from, for instance, a part near a coil. Thus, an effect for preventing a freeze is insufficient.

The present invention is made in consideration of the above-described circumstances, and an object thereof is to provide an electromagnetic relay which restrains air of high temperature generated in the periphery of a coil from reaching a contact part, restrains a vapor condensation from being generated in the contact part and prevents a failure of electric conduction of the contact part.

Means for Solving the Problem

In order to achieve the above-described object, an electromagnetic relay of the invention includes: an electromagnet block including a bobbin comprising collar parts at both ends of a coil winding part on which a coil is wound, an iron core inserted into an axis of the bobbin, and a yoke forming a magnetic circuit together with the iron core; a contact block including a fixed contact, and a movable contact which freely contacts and is separated from the fixed contact in accordance with an operation of turning on/off a current to the coil; a pair of partition walls provided in parallel with the axial direction of the coil, opposing each other with the coil sandwiched therebetween and abutting on both the collar parts of the bobbin; and a case that accommodates therein the electromagnet block, the contact block and the partition walls. In the electromagnetic relay, inner wall surfaces of the case abut on both the collar parts of the bobbin and the partition walls from a direction intersecting both a direction in which the pair of partition walls oppose and the axial direction of the bobbin.

In the above-described configuration, the case includes a substantially plate shaped base that holds the electromagnet block and the contact block, and a plurality of cover pieces connected to one another and attached to the base so as to cover the electromagnet block and the contact block, the pair of partition walls protrude along a connecting direction from a pair of inner wall surfaces opposing the connecting direction of the inner wall surfaces of a cover formed by connecting the plurality of cover pieces, and fitting grooves which are sliding fitted to end parts of the base are formed along the connecting direction, on the inner wall surfaces extending along the connecting direction of the inner wall surfaces of the cover.

Further, an electromagnetic relay of the invention includes: a bobbin comprising a winding part and jaw parts extending from both ends of the winding part; a coil wound on the winding part of the bobbin; an iron core attached to the bobbin; an armature supported so as to be freely swung by a hinge spring and magnetically attracted to one end of the iron core by supplying a current to the coil; a movable contact which contacts or is separated from a fixed contact in accordance with a swing movement of the armature; and a case that accommodates the elements. In the electromagnetic relay, the jaw part of the bobbin is formed to extend to a part in the vicinity of a side wall of the case so as to separate a space where the coil exists from a space where the fixed contact and the movable contact exist.

In the above-described configuration, the jaw part of the bobbin is formed to extend to the part in the vicinity of the side wall of the case, and further extend toward the space where the movable contact and the fixed contact exist.

In the above-described configuration, the jaw part of the bobbin is formed to extend to the part in the vicinity of a side wall of the case, and further extend toward the space where the coil exists.

In the above-described configuration, a protruding part is provided in the side wall of the case correspondingly to an extended part obtained by extending the jaw part of the bobbin to the part in the vicinity of the side wall of the case.

Further, an electromagnetic relay of the invention includes: an electromagnet block including a bobbin on which a coil is wound, an iron core inserted into an inside diameter part of the bobbin, and a yoke forming a magnetic circuit together with the iron core; a contact block including a fixed contact, and a movable contact which freely contacts and is separated from the fixed contact in accordance with an operation of turning on/off a current to the coil; and a case that accommodates therein the electromagnet block and the contact block. In the electromagnetic relay, the electromagnet block is arranged in one surface side of the case, the contact block is arranged in the other surface side opposing the one surface of the case, and the bobbin and the yoke abut on an inner surface of the case, whereby a space where the coil is arranged is isolated from a space where the contact block is arranged.

In the above-described configuration, a protruding part is formed from one surface of the case, the protruding part abuts on the bobbin and the yoke, and the bobbin and the yoke are allowed to abut on a side surface of the case which connects the one surface to the other surface of the case.

Advantages of the Invention

An electromagnetic relay of the invention can restrain air of high temperature generated in the periphery of a coil from reaching a contact part, restrain a vapor condensation from being generated in the contact part and prevent a failure of electric conduction of the contact part.

MODE FOR CARRYING OUT THE INVENTION

Figure 1:
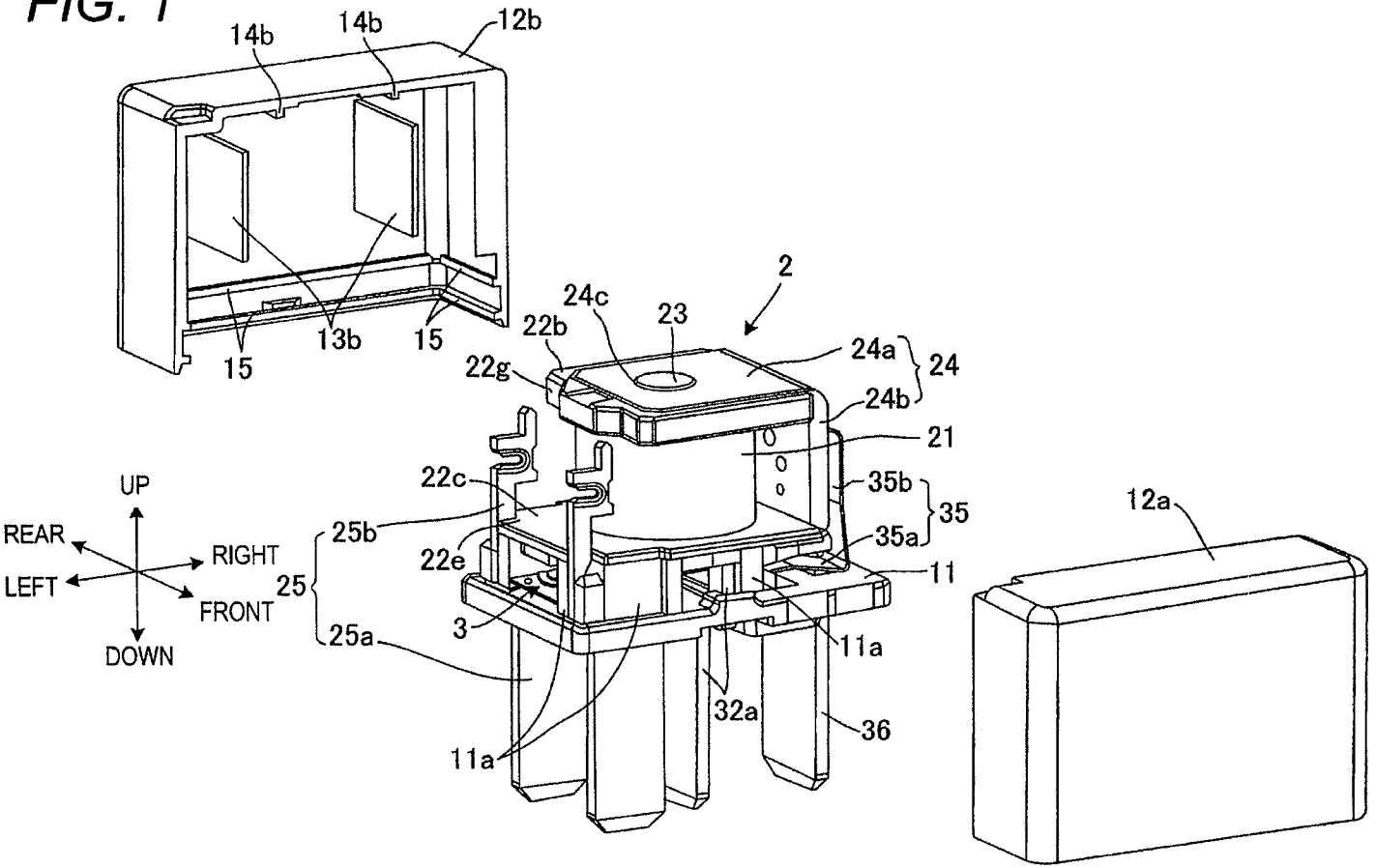
FIG. 1 is an exploded perspective view of an electromagnetic relay according to a first exemplary embodiment of the present invention.

Now, exemplary embodiments of the present invention will be described below by referring to the drawings.

First Exemplary Embodiment

Figure 2:
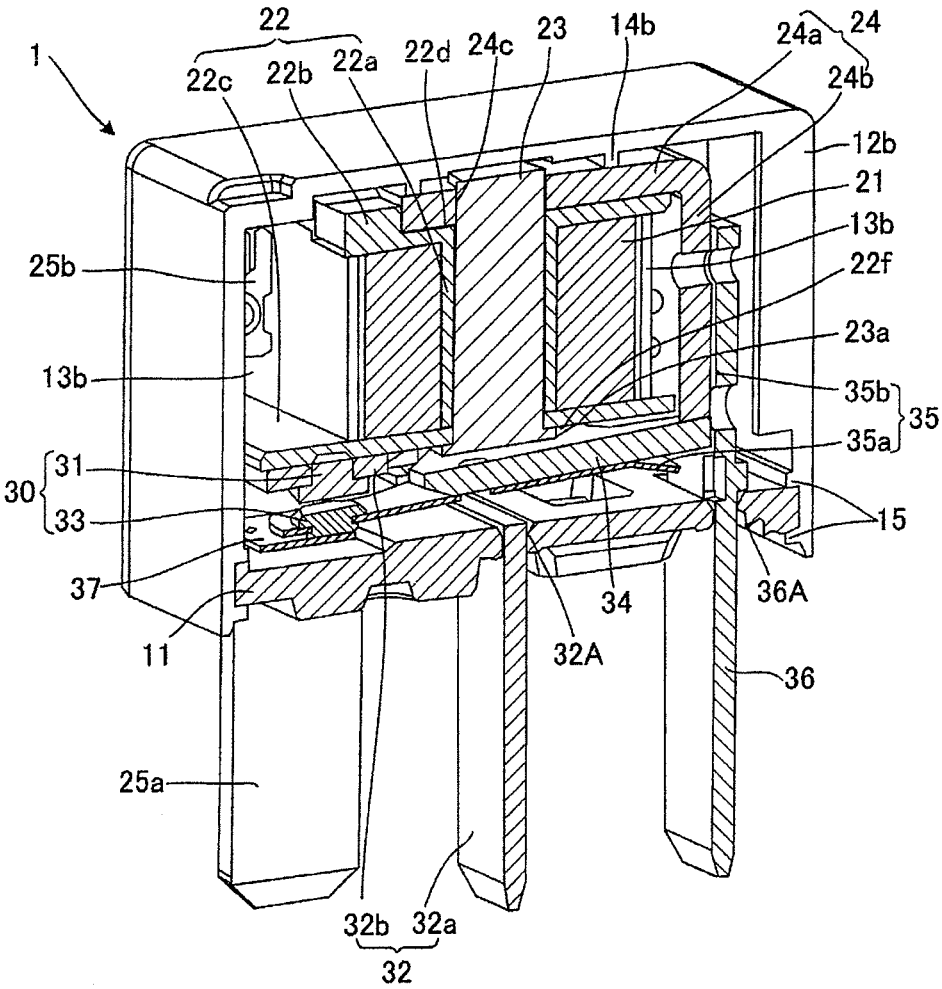
FIG. 2 is a sectional view of the electromagnetic relay shown in FIG. 1.
Figure 3:
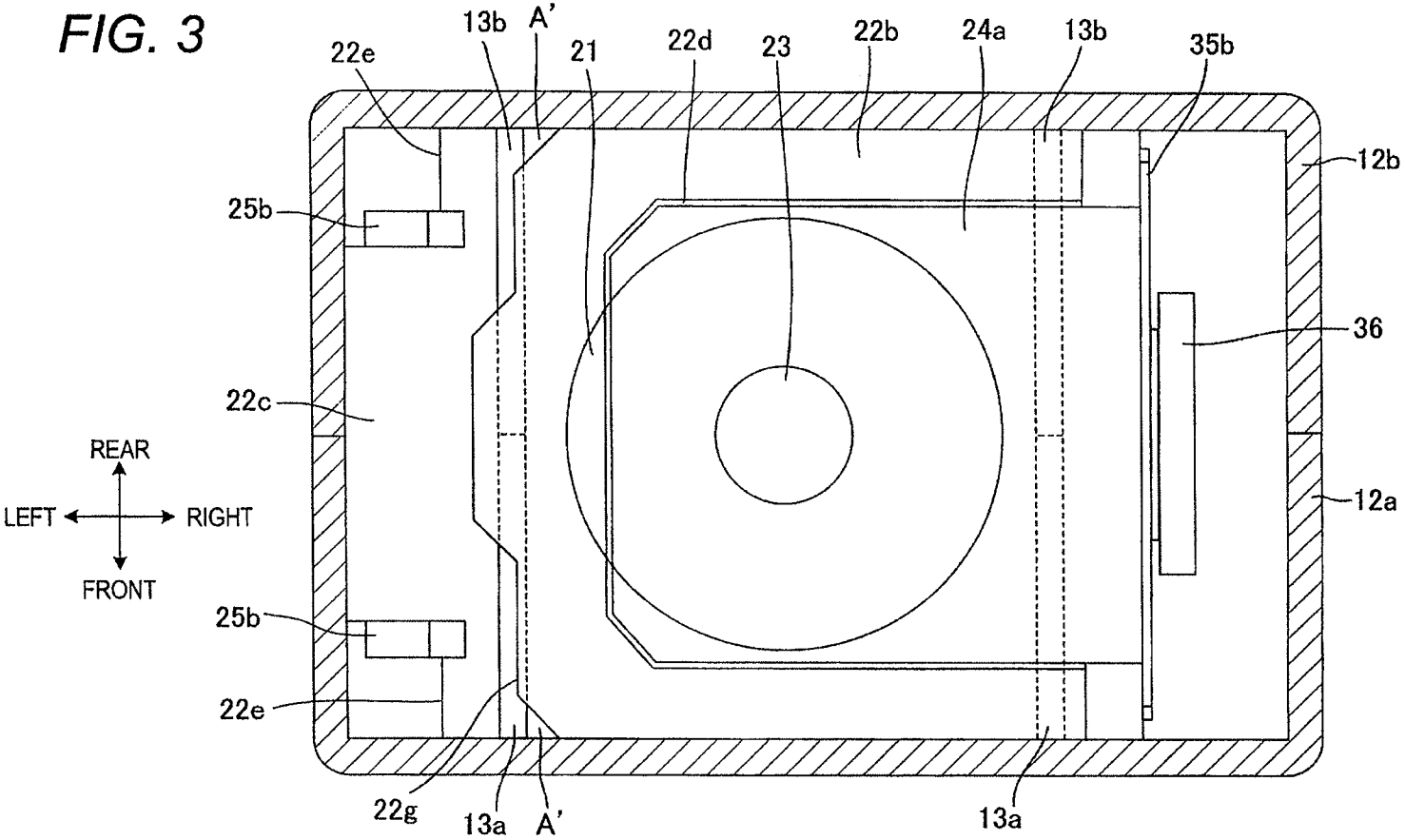
FIG. 3 is a schematic top view of the electromagnetic relay shown in FIG. 1.

In this exemplary embodiment, as shown in FIGS. 1 to 3, an electromagnet block 2 and a contact block 3 are accommodated in a case 1 formed in the shape of a box with an insulating material such as a resin. In a below-described explanation, upper and lower parts, a right and left parts and front and rear parts are prescribed in FIG. 1.

The electromagnet block 2 includes a hollow and cylindrical coil bobbin 22 on which a coil 21 is wound, an iron core 23 inserted into an inside diameter part 22*a* of the coil bobbin 22 and a yoke 24 forming a magnetic circuit together with the iron core 23.

The coil bobbin 22 is formed with an insulating material such as a resin and has an upper collar part 22*b* and a lower collar part 22*c* formed in both upper and lower ends in the axial direction. The coil 21 is wound between the upper collar part 22*b* and the lower collar part 22*c*. The upper collar part 22*b* has the form of a substantially rectangular plate provided with a pair of stepped parts 22*g* at both front and rear ends of a left end, and includes a recessed part 22*d* in an upper surface and an insert hole at a center into which the iron core 23 is inserted. An end face in a forward and rearward direction abuts on an inner wall surface of the case 1. The lower collar part 22*c* has the form of a substantially rectangular plate provided with a pair of stepped parts 22*e* at both front and rear ends of a left end and has a circular recessed part 22*f* formed on a lower surface in the periphery of the insert hole formed at the central part into which the iron core 23 is inserted. A forward and rearward end face abuts on an inner wall surface of the case 1.

The iron core 23 is formed in the shape of a long cylindrical pole having a disk shaped collar part 23*a* in a lower end and the collar part 23*a* is fitted to the recessed part 22*f* formed in the lower collar part 22*c* of the coil bobbin 22.

The yoke 24 is formed substantially in the shape of L with a magnetic material by one substantially rectangular plate shaped piece 24*a* and the other piece 24*b* extended downward from a right end of the one piece 24*a*. The one piece 24*a* is fitted to the recessed part 22*d* formed in the upper collar part 22*b* of the coil bobbin 22 and has an insert hole 24*c* formed. An upper end part of the iron core 23 is inserted into the insert hole 24*c*.

A pair of coil terminals 25 formed with an electrically conductive material such as copper include long plate shaped terminal parts 25*a* long in the vertical direction and connecting parts 25*b* passing through openings formed by the stepped parts 22*e* and protruding upward from left end faces of the terminal parts 25*a*. On the connecting parts 25*b*, ends of the coil 21 led out through openings A' (see FIG. 3) are wound (not shown in the drawing) and fixed by solder or the like.

The contact block 3 includes a fixed contact terminal 32 provided with a fixed contact 31, a movable contact plate 35 having a movable contact 33 provided and an armature 34 fixed and a mount plate 37 provided at a position opposed to the fixed contact 31 with respect to the movable contact 33.

The fixed contact terminal 32 is formed substantially in the shape of L with an electrically conductive material such as copper by a long flat plate shaped terminal part 32*a* which is long in the vertical direction and has an upper part divided in a recessed shape forward and rearward and a flat plate shaped extending part 32*b* having a right part divided in a recessed shape forward and rearward and extended leftward from the upper end of the terminal part 32*a* divided in the recessed shape. To a hollow part surrounded by an upper recessed shaped clearance of the terminal part 32*a* and a right recessed shaped clearance of the extending part 32*b*, the armature 34 and the movable contact plate 35 are inserted. Further, an upper surface of the extending part 32*b* abuts on a lower surface of the lower collar part 22*c* of the coil bobbin 22. In the vicinity of an end of the extending part 32*b*, the fixed contact 31 is provided to pass.

The mount plate 37 is formed substantially in the shape of a rectangular flat plate with an insulating material and the movable contact 33 is mounted on the mount plate when a current is not supplied to the coil 21.

The armature 34 is formed substantially in the shape of a long flat plate with a magnetic material and arranged so as to be opposed to the collar part 23*a* of the iron core 23.

The movable contact plate 35 is formed substantially in the shape of L with an electrically conductive material such as copper by a leaf spring shaped operating piece 35*a* long in a transverse direction and a fixed piece 35*b* extended upward from a right end of the operating piece 35*a*. The armature 34 is fixed to an upper surface of the operating piece 35*a* and the movable contact 33 is provided at a position opposed to the fixed contact 31 and the mount plate 37 in the vicinity of an end. The movable contact 33 freely contacts and is separated from the fixed contact 31 in accordance with an operation of turning on/off for supplying a current to the coil 21. Further, the fixed piece 35*b* is provided between the other piece 24*b* of the yoke 24 and a movable contact terminal 36 and fixed to an upper end side of the movable contact terminal 36 and the other piece 24*b* of the yoke 24 by caulking. The movable contact terminal 36 is formed in the shape of a long plate long in the vertical direction with an electrically conductive material such as copper.

In the present exemplary embodiment, a contact structure of, what is called, a contact a is provided in which when the current is not supplied to the coil 21, the movable contact 33 is mounted on the mount plate 37, and when the current is supplied to the coil 21, the movable contact 33 abuts on the fixed contact 31 to close a circuit.

The case 1 includes a substantially rectangular plate shaped base 11 and a substantially rectangular box shaped cover 12 having a lower surface opened.

On an upper surface of the base 11, a plurality of substantially rectangular parallelepiped holding parts 11*a* protrude on which the lower collar part 22*c* of the coil bobbin 22 is mounted and held. On upper surfaces of the holding parts 11*a* respectively, engaging protrusions (not shown in the drawings) protrude and are respectively fitted to a plurality of engaging holes (not shown in the drawing) provided in a lower surface of the lower collar part 22*c*. Further, in the base 11, insert holes 32A, 36A and 25A are opened into which the terminal part 32*a* of the fixed contact terminal 32, the movable contact terminal 36 and the terminal parts 25*a* of the one pair of coil terminals 25 are respectively inserted. The base 11 holds the electromagnet block 2 and the contact block 3 by inserting the terminals respectively into the insert holes ands mounting the lower collar part 22*c* on the holding parts 11*a*.

The substantially box shaped cover 12 has cover pieces 12*a* and 12*b* which are formed by dividing the cover into two at a center in a forward and rearward direction.

On an inner wall surface (a front surface) of a rear wall of the cover piece 12*b*, a pair of substantially rectangular plate shaped partition walls 13*b* protrude vertically to the rear wall and an upper wall. Further, on an inner wall surface (a lower surface) of the upper wall, a pair of substantially rectangular plate shaped partition walls 14*b* protrude vertically to the upper wall and the rear wall. Similarly, on an inner wall surface (a rear surface) of a front wall of the cover piece 12*a*, a pair of substantially rectangular plate shaped partition walls 13*a* the same as the partition walls 13*b* protruding in the cover piece 12*b* protrude vertically to the front wall and an upper wall and symmetrically with the partition walls 13*b*. Further, on an inner wall surface (a lower surface) of the upper wall, a pair of substantially rectangular plate shaped partition walls (not shown in the drawing) similar to the partition walls 14*b* protruding in the cover piece 12*b* protrude vertically to the upper wall and the front wall and symmetrically with the partition walls 14*b*.

The two pairs of partition walls 13*a* and 13*b* are respectively parallel to an axis of the coil bobbin 22 and protrude so as to be opposed to each other with the axis sandwiched between the partition walls. The partition walls 13*a* and 13*b* abut on each other in their end faces parallel to the front wall and the rear wall. Further, a vertical length of the partition walls 13*a* and 13*b* is substantially equal to a space between the upper collar part 22*b* and the lower collar part 22*c* of the coil bobbin 22. Both upper and lower end faces of the partition walls 13*a* and 13*b* respectively abut on the upper collar part 22*b* or the lower collar part 22*c* of the coil bobbin 22.

The partition walls protruding on the upper wall of the cover piece 12*a* which are not shown in the drawing and the partition walls 14*b* abut on each other in their end faces parallel to the front wall and the rear wall. Further, a vertical space between upper surfaces of the partition walls 13*b* and lower surfaces of the partition walls 14*b* is substantially equal to a vertical thickness obtained by the upper collar part 22*b* of the coil bobbin 22 and the one piece 24*a* of the yoke 24 and lower end faces of the partition walls 14*b* abut on the yoke 24 to hold the upper collar part 22*b* and the one piece 24*a* together with the partition walls 13*b*. Similarly, in the cover piece 12*a*, the upper collar part 22*b* and the one piece 24*a* are held between the partition walls protruding on the upper wall which are not shown in the drawing and the partition walls 13*a*.

In lower ends of inner wall surfaces of the cover 12, U shaped ribs 15 to which an end face of the base 11 is fitted are provided along an inner peripheral edge of the opened lower bottom surface of the cover 12.

Namely, the case 1 is formed in such a way that right and left end faces of the base 11 are respectively fitted to the ribs 15 provided in the right and left inner wall surfaces of the cover pieces 12*a* and 12*b*, the cover pieces 12*a* and 12*b* are slid forward and rearward along the ribs 15, and then, front and rear end faces of the base 11 are fitted to the ribs 15 provided in the front and rear inner walls of the cover pieces 12*a* and 12*b*.

In the electromagnetic relay of the present exemplary embodiment having the above-described structure, when the current is supplied to the coil 21, the iron core 23 is magnetized so that the armature 34 is attracted to and abuts on the collar part 23*a* of the iron core 23. In accordance therewith, the end of the operating piece 35*a* of the movable contact plate 35 fixed to the armature 34 is displaced upward and the movable contact 33 provided at the end abuts on the fixed contact 31. Thus, the fixed contact terminal 32 is electrically conducted to the movable contact terminal 36.

Here, in the present exemplary embodiment, the coil 21 that generates heat when the current is supplied thereto is surrounded by the partition walls 13, the inner wall surfaces of the cover 12 and the upper collar part 22*b* and the lower collar part 22*c* of the coil bobbin 22 and isolated from a contact part 30 including the fixed contact 31 and the movable contact 33. Accordingly, air in the periphery of the coil 21 of high temperature due to the heat generation of the coil 21 hardly directly reaches the contact part 30. The coil bobbin 22 or the iron core 23 are supposed to be heated by the coil 21 or the air in the periphery thereof and the temperature of air in the periphery of the contact part 30 is supposed to rise due to the heated coil bobbin 22 or iron core 23. However, an effect of the rise of temperature at this time is smaller than that obtained when the air in the periphery of the coil 21 directly reaches the periphery of the contact part 30. Further, at this time, since the temperature of the fixed contact terminal 32 abutting on the coil bobbin 22 and the movable contact plate 35 or the armature 34 abutting on the iron core 23 or the yoke 24 also rises, a temperature difference hardly arises between the contact part 30 and the air in the periphery thereof, so that the contact part 30 hardly reaches a dew point temperature of the air in the periphery thereof or lower. Thus, a vapor condensation can be restrained from occurring in the contact part 30.

As described above, in the present exemplary embodiment, the coil 21 is isolated by the cover 12, the partition walls 13, the upper collar part 22*b* and the lower collar part 22*c* of the coil bobbin 22 to restrain the air of high temperature in the vicinity of the coil 21 from reaching the contact part 30. Thus, the vapor condensation can be effectively restrained from occurring in the contact part 30 and a failure of electric conduction of the contact part 30 can be prevented. Further, since the ribs 15 to which the base 11 is sliding fitted are provided along the inner peripheral edge of the opened bottom surface of the box shaped cover 12 which is divided into two, the case 1 can be simply formed.

The present invention is not limited to the structure of the above-described exemplary embodiment, and the case 1 or the electromagnet block 2 and the contact block 3 may have other forms.

For in stance, in the case 1, the cover 12 does not need to be divided at the center in the forward and rearward direction as shown in the drawing. The cover may be divided in a forward and rearward direction along the front inner wall surface, and recessed parts to which the partition walls 13*b* are fitted may be provided in the inner wall surface (a rear surface) of the front wall of the cover piece 12*a* to form the case 1, or the cover 12 may be divided into three or more. Further, the partition walls 13 may be formed as separate parts from the cover 12 and fitting grooves to which front and rear end faces of the partition walls 13 are fitted may be provided as recessed parts respectively on the inner wall surfaces of the cover pieces 12*a* and 12*b*.

In the electromagnet block 2, for instance, the coil bobbin 22 may be provided in the horizontal direction so that an axis of the coil bobbin 22 extends in a transverse direction and a pair of partition walls 13 may be provided in the horizontal direction in an upper part and a lower part of the coil 21 so as to be parallel to the axis of the coil bobbin 22 and hold the coil 21 between them. In the contact block 3, the structures of contacts or terminals may be respectively suitably replaced by other structures so as to have, for instance, a contact structure of a contact b or a contact c.

Second Exemplary Embodiment

Figure 4:
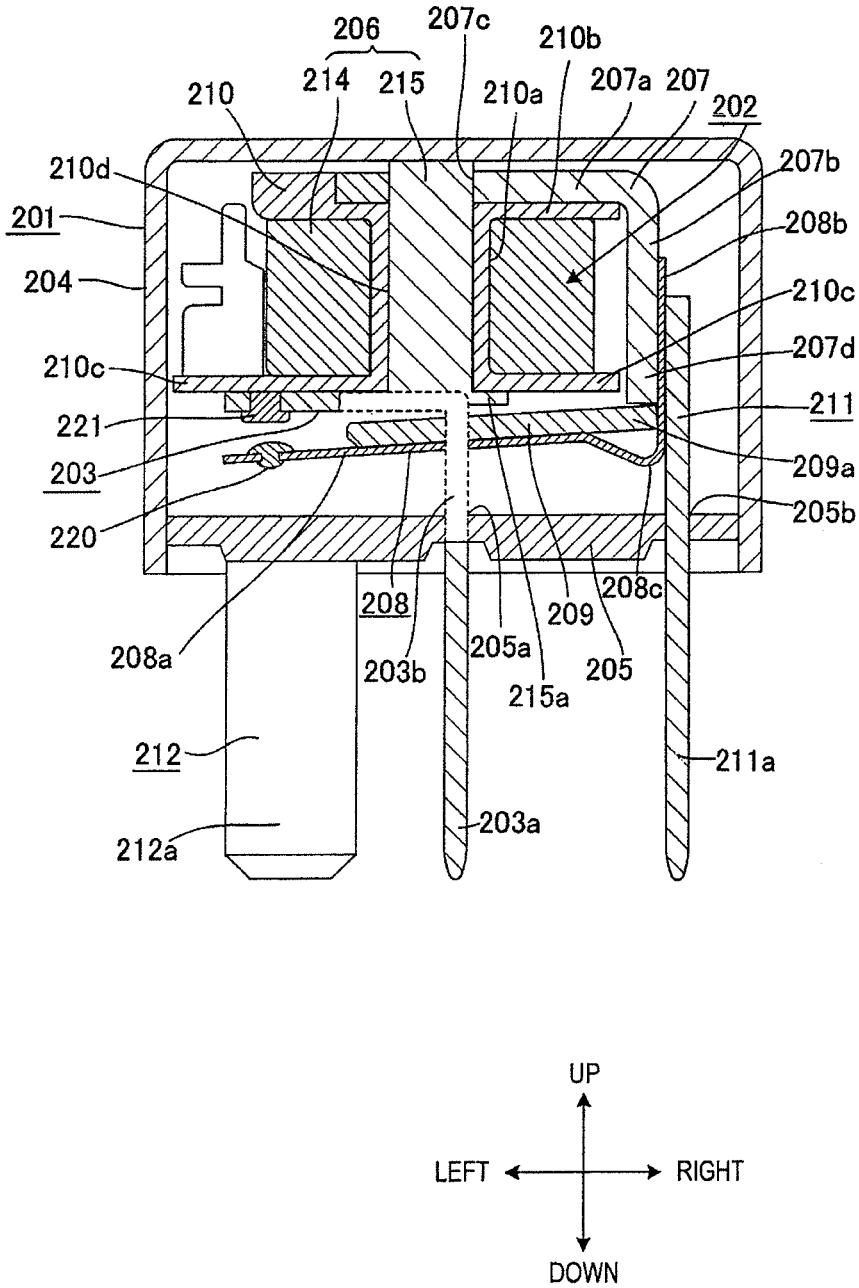
FIG. 4 is a longitudinally sectional view of an electromagnetic relay according to a second exemplary embodiment of the present invention.
Figure 5:
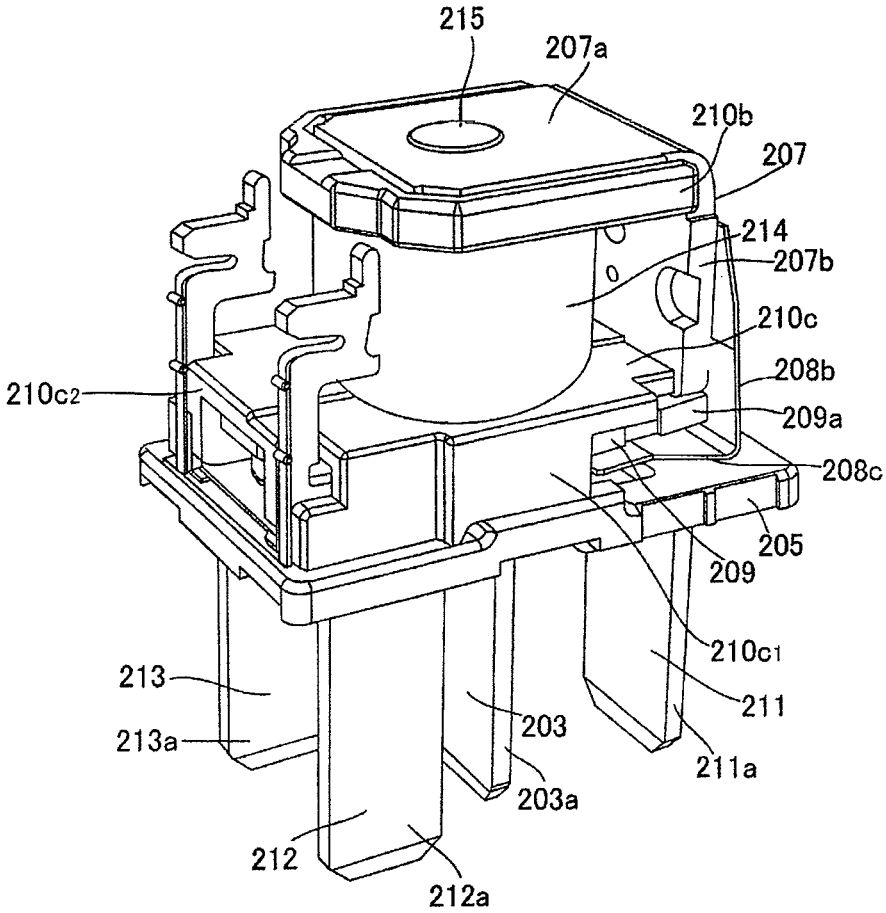
FIG. 5 is a perspective view showing an inner structure of the electromagnetic relay shown in FIG. 4.
Figure 6:
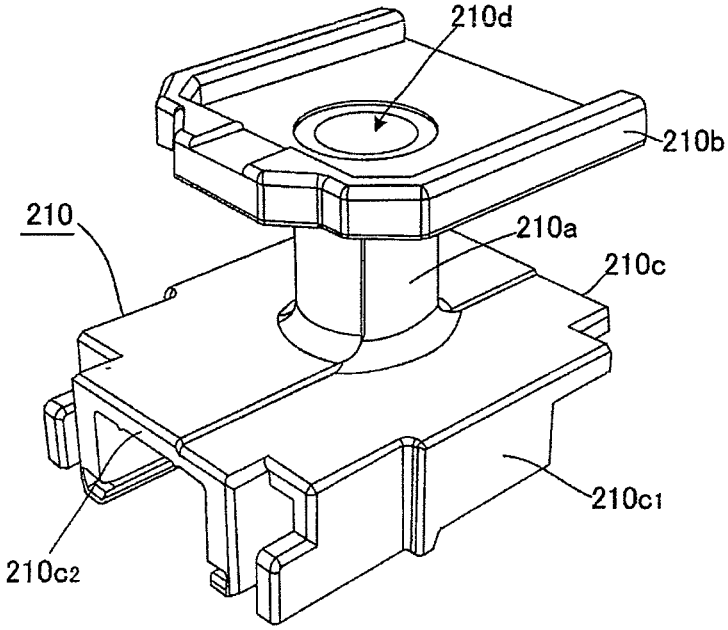
FIG. 6 is a perspective view showing an external appearance of a bobbin of the electromagnetic relay shown in FIG. 4.
Figure 7:
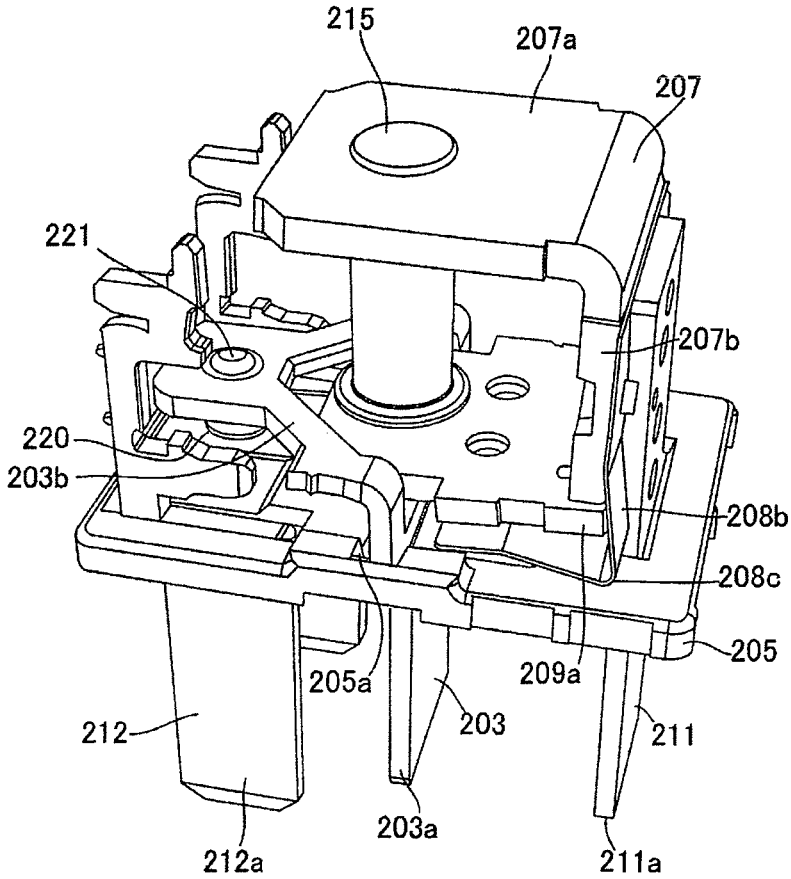
FIG. 7 is a perspective view showing an inner structure except the bobbin and a coil in the electromagnetic relay shown in FIG. 4.

FIG. 4 is a longitudinally sectional view of an electromagnetic relay according to a second exemplary embodiment of the present invention. FIG. 5 is a perspective view showing an inner structure of the electromagnetic relay shown in FIG. 4. FIG. 6 is a perspective view showing an external appearance of a bobbin of the electromagnetic relay shown in FIG. 4. FIG. 7 is a perspective view showing an inner structure except the bobbin and a coil in the electromagnetic relay shown in FIG. 4.

In FIGS. 4 to 7, an electromagnetic relay of this exemplary embodiment includes a main body part 202, a terminal 203 for a fixed contact and a case 201 that accommodates therein the main body part 202 and the terminal 203 for the fixed contact and formed generally in the shape of a substantially rectangular parallelepiped box.

The case 201 includes a body 204 made of a box shaped synthetic resin product having a lower surface opened and a base 205 formed in the shape of a substantially rectangular flat plate and is used by covering the body 204 on the base 205 from an upper part. On the base 205, four through holes in total (only two parts 205*a* and 205*b* are shown in the drawing) are arranged which pass through in elongated rectangular forms. Two through holes of the four through holes which are not shown in the drawing are arranged in parallel in an interior direction in a part nearer to a left side than to a central part in the transverse direction of the base 205 with their longitudinal directions directed toward the transverse direction. The two through holes 205*a* and 205*b* which are shown in the drawing are respectively arranged substantially at the central part in the transverse direction of the base 205 and at a part nearer to a right side than to the central part with their longitudinal directions directed toward the interior direction.

The main body part 202 includes an electromagnet 206, a yoke 207, a movable spring 208, an armature 209, a bobbin 210, a terminal 211 for a movable contact and a pair of coil terminals 212 and 213 (for the coil terminal 213, see FIG. 5 or FIG. 6). Further, the electromagnet 206 includes an exciting coil 214 wound on the bobbin 210 and an iron core 215 inserted along a central axis of the bobbin 210.

The bobbin 210 is formed with a resin material having an electrically insulating characteristic. As shown in FIG. 6, the bobbin integrally includes a winding part 210*a* and an upper jaw part 210*b* and a lower jaw part 210*c* provided in upper and lower end parts of the winding part 210*a*. The winding part 210*a* is formed in a cylindrical shape and provided with a through hole 210*d* passing through the upper and lower end parts along a central axis thereof. On an outer peripheral surface of the winding part 210*a*, the coil 214 is wound and the iron core 215 is inserted into the through hole 210*d*.

In the upper jaw part 210*b*, an upper end part of the winding part 210*a* is formed substantially in the shape of U viewed from an upper part and an opening of the U shape is directed to a right side. The lower jaw part 210*c* is formed substantially in the shape of U. A side wall part 210$c_1$ (see FIG. 6) is extended to a part nearer to the terminal 211 for the movable contact than to a center of the body part 210*a* relative to the transverse direction. Further, a front end part 210$c_2$ (see FIG. 6) of the lower jaw part 210*c* is extended to a part in the vicinity of a side wall of an inner side of the case 201. In such a way, the lower jaw part 210*c* of the bobbin 2010 separates a space where the coil 214 exists from a space where a movable contact 220 and a fixed contact 221 exist.

The one pair of coil terminals 212 and 213 are formed with substantially rectangular plates having an electric conductivity and respectively fixed to front end parts in the interior direction of the bobbin 210 with their longitudinal directions toward a vertical direction. Terminal pieces 212*a* and 213*a* extended in lower end parts of the coil terminals 212 and 213 respectively protrude outside the case 201 through the above-described two insert holes (not shown in the drawing) passing through the base 205. To upper end parts of the coil terminals 212 and 213, a winding start end and a winding finish end of the coil 214 are electrically connected (both parts are not shown in the drawing). Namely, an electric current can be fed to the coil 214 through the terminal pieces 212*a* and 213*a*.

The iron core 215 is formed in a cylindrical shape and has a lower end part provided with a jaw part 215*a* formed in the shape of a disk. A dimension of an outside diameter of the jaw part 215*a* is larger than a dimension of an outside diameter of a cylindrical main body part.

The yoke 207 is formed by bending a rectangular plate substantially at a central part in the longitudinal direction and includes a horizontal part 207*a* parallel to a horizontal plane and a rising part 207*b* extending downward from a right end part of the horizontal part 207*a* to form a magnetic path of a magnetic flux in the periphery of the coil 214. The horizontal part 207*a* is fitted to the upper jaw part 210*b* formed in the shape of U from a direction of a right side. Further, in the horizontal part 207*a*, a through hole 207*c* passes through in the vertical direction. An upper end part of the iron core 205 protruding upward from the through hole 210*d* of the bobbin 210 is caulked and fixed to the through hole 207*c* to connect the yoke 207 to the iron core 205. On the other hand, in the lower end part of the iron core 215, since the jaw part 215*a* abuts on a lower surface of the lower jaw part 210*c* of the bobbin 210, the yoke 207 and the iron core 215 do not slip out from the bobbin 210. The rising part 207*b* is spaced from the coil 214 and arranged in parallel with a central axis of the iron core 215. In a right side of the rising part 207*b*, a plurality of protrusions (not shown in the drawing) protruding to the right side are provided.

The movable spring 208 is formed by bending an electrically conductive thin plate such as a copper plate substantially in the shape of L and includes an operating part 208*a* parallel to a horizontal plane, a fixed part 208*b* parallel to a normal direction of the horizontal plane and a hinge spring part 208*c* as a bent part between the operating part 208*a* and the fixed part 208*b*. The operating part 208*a* is extended leftward. To a part near to the right side on an upper surface of the operating part 208*a*, the armature 209 is fixed by caulking. In a left end part of the operating part 208*a*, a hole part is formed which passes through in the vertical direction and the movable contact 220 formed substantially in a spherical shape is caulked and fixed to the hole part. A top part of the movable contact 220 in the vertical direction is opposed to the below-described fixed contact 221. Then, in the fixed part 208*b*, a plurality of hole parts (not shown in the drawing) are provided which pass through in the transverse direction and the fixed part is caulked and fixed to a rear surface of the rising part 207*b* through the above-described plurality of protrusions together with the terminal 211 for the movable contact. At this time, the left end part of the operating part 208*a* is inserted from a right side opening of the lower jaw part 210*c* of the bobbin 210.

The terminal 211 for the movable contact is formed in the shape of a rectangular plate with an electrically conductive material and electrically connected to the movable contact 220 through the movable spring 208. As described above, the terminal 211 for the movable contact is caulked and fixed to the right surface of the rising part 207*b* together with the movable spring 208. A terminal piece 211*a* arranged in a lower end part of the terminal 211 for the movable contact protrudes outside the case 201 through the through hole 205*b* of the base 205.

The armature 209 is formed substantially in the shape of a rectangular plate with a magnetic material and caulked and fixed to the part near to the right side on the upper surface of the operating part 208*a*. Further, a right end part 209*a* of the armature 209 abuts on a lower end part 207*d* of the rising part 207*b* over the interior direction. Namely, the yoke 207 supports the armature 209 so as to be freely swung in the vertical direction through the movable spring 208. Further, the electromagnet 206, the yoke 207, the movable spring 208, the armature 209 and the terminal 211 for the movable contact mutually cooperates to form a magnetic circuit by the coil 214.

The terminal 203 for the fixed contact is formed in the shape of a belt with an electrically conductive material and has the fixed contact 221 in one end part and a terminal piece 203*a* in the other end part. A connecting part 203*b* that connects the one end part to the other end part of the terminal 203 for the fixed contact is formed substantially in the shape of V which sandwiches the bobbin 210 as shown in FIG. 7. The terminal piece 203*a* is bent downward at right angles respectively to two end parts of the V shape of the connecting part 203*b*.

The fixed contact 321 includes a jaw part formed substantially in the shape of a disk and a protruding part protruding upward from a central part of the jaw part. In the one end part of the terminal 203 for the fixed contact, a hole part is provided which passes through in the vertical direction and the head part of the fixed contact 221 is directed downward to caulk and fix the protruding part to the hole part. Thus, the fixed contact 221 is fixed to the one end part of the terminal 203 for the fixed contact. The jaw part is arranged to be opposed to the upper top part of the movable contact 220 of the movable spring 208. On the other hand, the terminal piece 203*a* protrudes outside the case 201 through the through hole 205*a* of the base 205.

Now, a basic operation of the electromagnetic relay of the present exemplary embodiment will be described below.

When the current is not supplied to the coil 214, the electromagnet 206 is not excited and the armature 209 is located at a position spaced from the jaw part 215*a* of the iron core 215. Namely, the movable contact 220 is separated from the fixed contact 221 so that the contact is opened. When the current is supplied to the coil 214 through the coil terminals 212 and 213 from this state, the electromagnet 206 is excited and the armature 209 is displaced upward on the right end part 209*a* as a supporting point against an elastic reset force of the movable spring 208 by an attracting force of the electromagnet 206 and attracted to the jaw part 251*a* of the iron core 215. In accordance with the attracting operation, the movable contact 220 is displaced upward integrally with the armature 209 through the operating part 208*a* of the movable spring 208. That is, the movable contact 220 comes into contact with the fixed contact, so that the contact is closed.

After that, when the current supplied to the coil 214 is turned off, since the electromagnet 206 is demagnetized and the attracting force of the electromagnet 206 disappears, the armature 209 is displaced downward oppositely to an attracting direction by the elastic rest force of the movable spring 208 and separated from the jaw part 215*a* of the iron core 215. In accordance with the separating operation, the movable contact 220 is displaced downward integrally with the armature 209 through the operating part 208*a* of the movable spring 208. That is, the movable contact 220 is separated again from the fixed contact 221, so that the contact is opened.

In such a way, in the electromagnetic relay of the present exemplary embodiment, the electromagnet 206 is repeatedly excited and demagnetized to allow the movable contact 220 to come into contact with or separate from the fixed contact 221 so that an opening and closing operation may be carried out.

Figure 8:
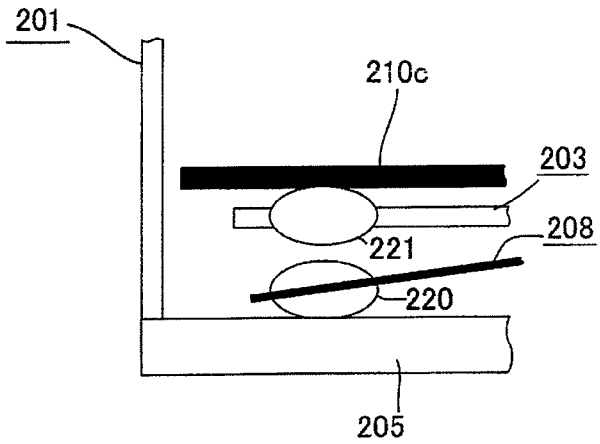
FIG. 8 is a diagram schematically showing a structure in the vicinity of a lower jaw part of the bobbin which is a characteristic part of the electromagnetic relay shown in FIG. 4.

Further, in the electromagnetic relay of the present exemplary embodiment, the lower jaw part 210*c* of the bobbin 210 is extended to the part in the vicinity of the side wall of the inner side of the case 201 to separate the space where the coil 214 exists from the space where the movable contact 220 and the fixed contact 221 exist. FIG. 8 schematically shows a structure in the vicinity of the lower jaw part 210*c* of the bobbin 210 which is a characteristic part of the electromagnetic relay of the present exemplary embodiment. Since a space between the side wall of the inner side of the case 201 and the front end part 210$c_2$ of the lower jaw part 210*c* of the bobbin 210 is narrow, even when a convection current of air including steam occurs in the case 201 due to the heat generation of the coil 214, the convection current is hardly directed to the movable contact 220 and the fixed contact 221. Thus, a freeze hardly occurs in the movable contact 220 and the fixed contact 221.

As described above, according to the electromagnetic relay of the present exemplary embodiment, since the bobbin 210 integrally including the winding part 210*a* and the upper jaw part 210*b* and the lower jaw part 210*c* provided in the upper and lower end parts of the winding part 210*a*, the coil 214 wound on the winding part 210*a* of the bobbin 210, the iron core 215 attached to the bobbin 210, the armature 209 supported by the movable spring 208 so as to be freely swung and magnetically attracted to one end of the iron core 215 when the current is supplied to the coil 214, the movable contact 220 which comes into contact with or is separated from the fixed contact 221 due to the swing movement of the armature 209 and the case 210 that accommodates the parts respectively are provided and the lower jaw part 210*c* of the bobbin 210 is extended to the part in the vicinity of the side wall of the inner side of the case 201 to separate the space where the coil 214 exists from the space where the movable contact 220 and the fixed contact 221 exist, the convection current is hardly directed to the movable contact 220 and the fixed contact 221 from the part in the vicinity of the coil 214, the occurrence of freeze in the movable contact 220 and the fixed contact 221 can be suppressed to be low and a contact performance between the contacts can be improved under an environment of low temperature.

Figure 9:
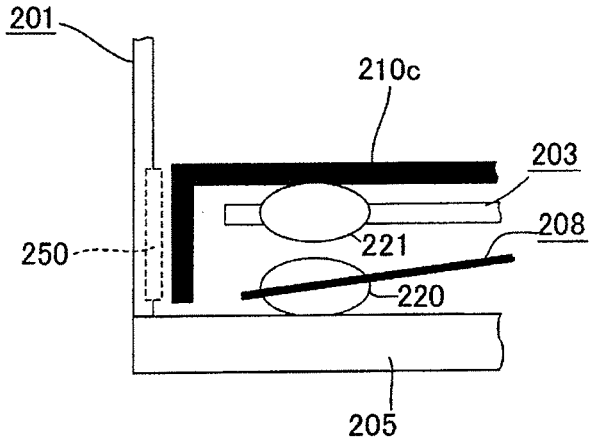
FIG. 9 is a diagram schematically showing a structure of other form 1 of the characteristic part of the electromagnetic relay shown in FIG. 4.
Figure 10:
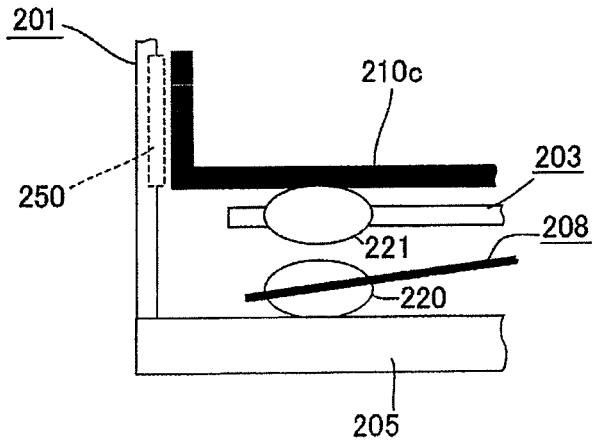
FIG. 10 is a diagram schematically showing a structure of other form 2 of the characteristic part of the electromagnetic relay shown in FIG. 4.
Figure 11:
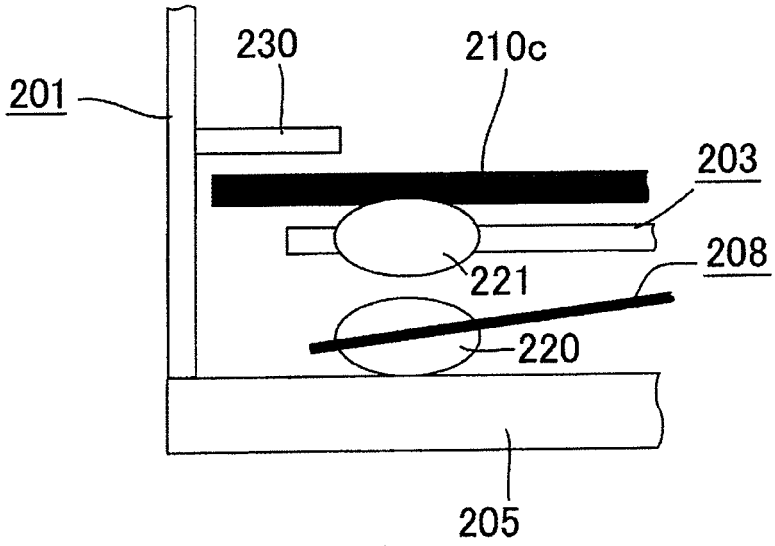
FIG. 11 is a diagram schematically showing a structure of other form 3 of the characteristic part of the electromagnetic relay shown in FIG. 4.

In the electromagnetic relay of the present exemplary embodiment, the lower jaw part 210*c* of the bobbin 210 is extended to the part in the vicinity of the side wall of the inner side of the case 201, however, such structures as shown in FIG. 9 to FIG. 11 may be employed.

(1) In a form shown in FIG. 9 (other form 1), a lower jaw part 210*c* of a bobbin 210 is extended to a part in the vicinity of a side wall of an inner side of a case 201, and then, further extended toward a space where a movable contact 220 and a fixed contact 221 are present. Between the extended part of the lower jaw part 210*c* of the bobbin 210 and the side wall of the inner side of the case 201, a vapor condensation 250 to the case 201 is promoted.

(2) In a form shown in FIG. 10 (other form 2), a lower jaw part 210*c* of a bobbin 210 is extended to a part in the vicinity of a side wall of an inner side of a case 201, and then, further extended toward a space where a coil 214 is present. Also in this form, between the extended part of the lower jaw part 210*c* of the bobbin 210 and the side wall of the inner side of the case 201, a vapor condensation 250 to the case 201 is promoted.

(3) In a form shown in FIG. 11 (other form 3), a protruding part 230 is provided in a side wall of an inner side of a case 201 correspondingly to an extended part obtained by extending a lower jaw part 210*c* of a bobbin 210 to a part in the vicinity of the side wall of the inner side of the case 201.

In the structure of the above-described (1), (2) or (3), convection current directed toward a movable contact 220 and a fixed contact 221 from a part in the vicinity of the coil 214 can be more reduced. The structure of (3) may be combined with (1).

The present invention is not limited to the above-described exemplary embodiments and may be suitably changed without departing from a range of an object of the present invention.

Third Exemplary Embodiment

Figure 12:
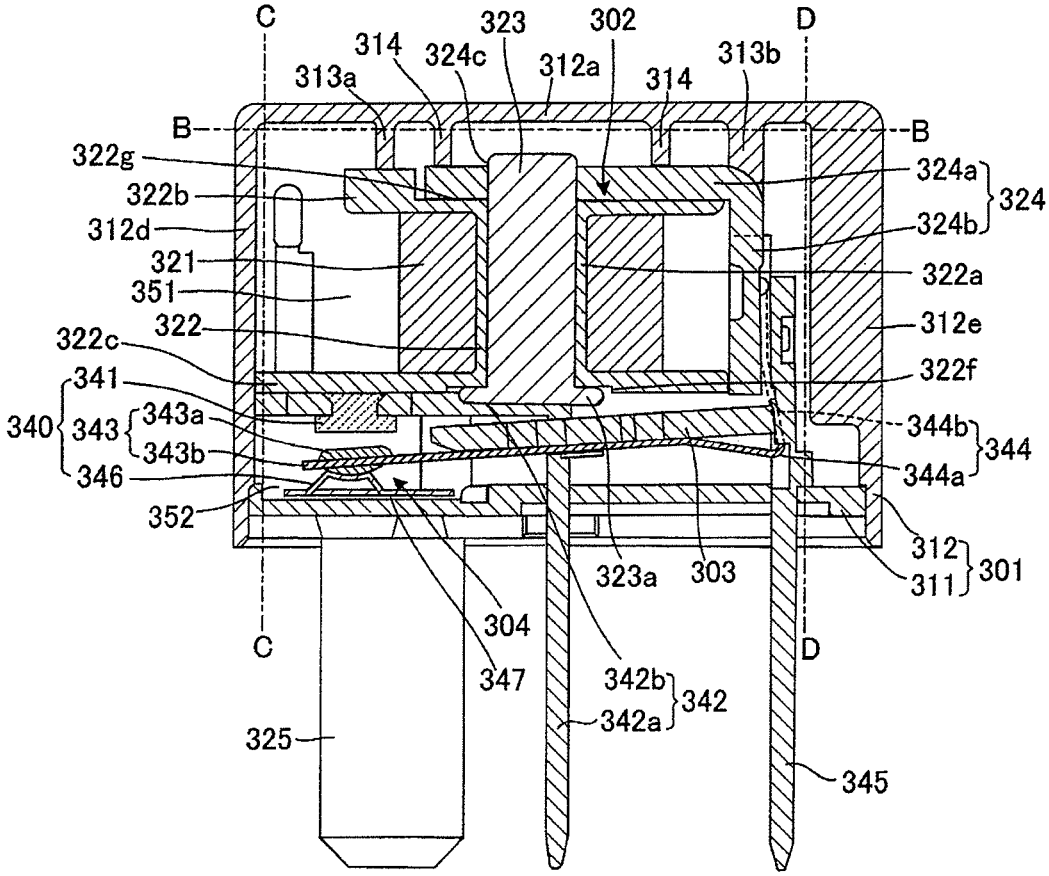
FIG. 12 is a sectional view taken along a line A-A of an electromagnetic relay according to a third exemplary embodiment of the present invention.
Figure 14:
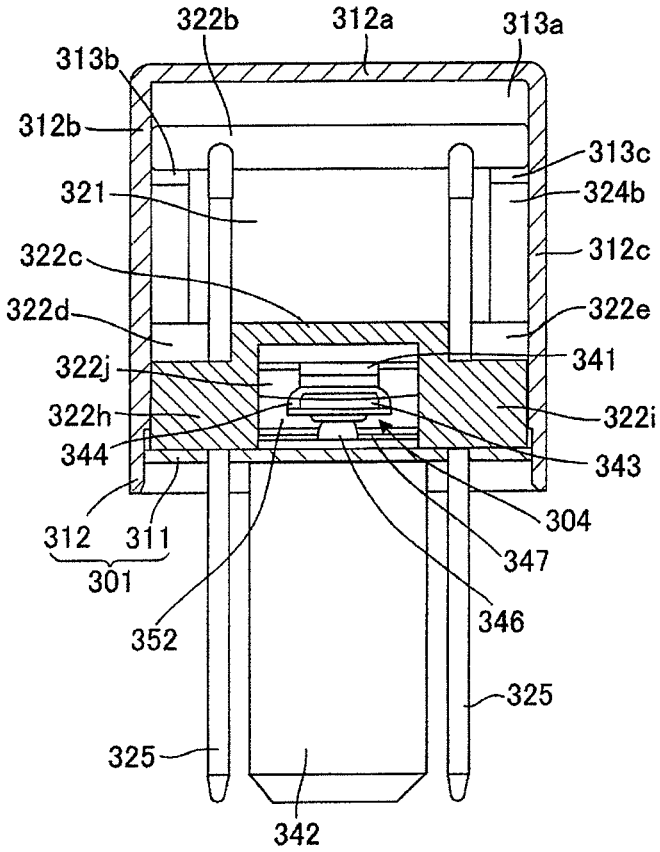
FIG. 14 is a sectional view taken along a line C-C of the electromagnetic relay shown in FIG. 12.
Figure 15:
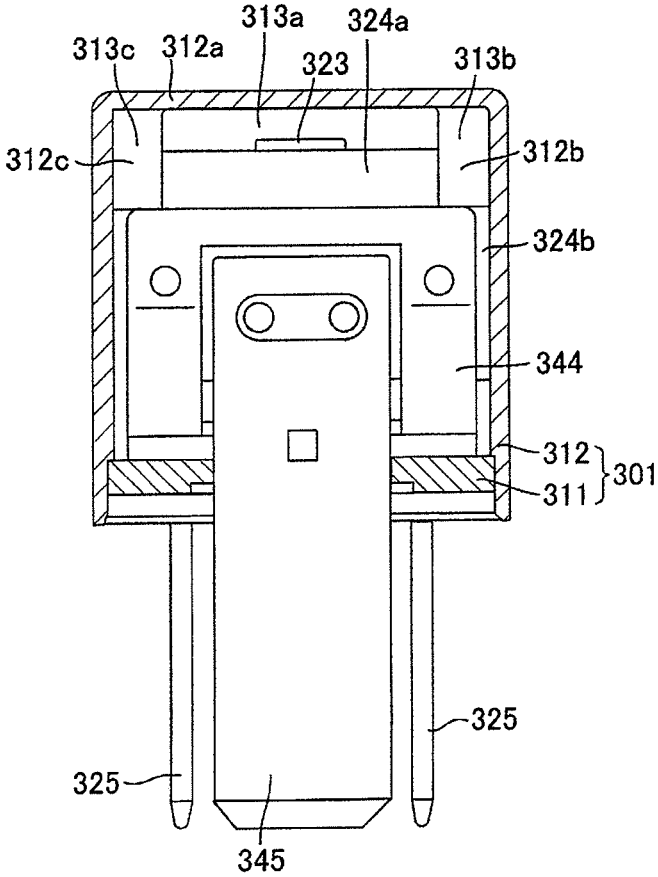
FIG. 15 is a sectional view taken along a line D-D of the electromagnetic relay shown in FIG. 12.
Figure 16:
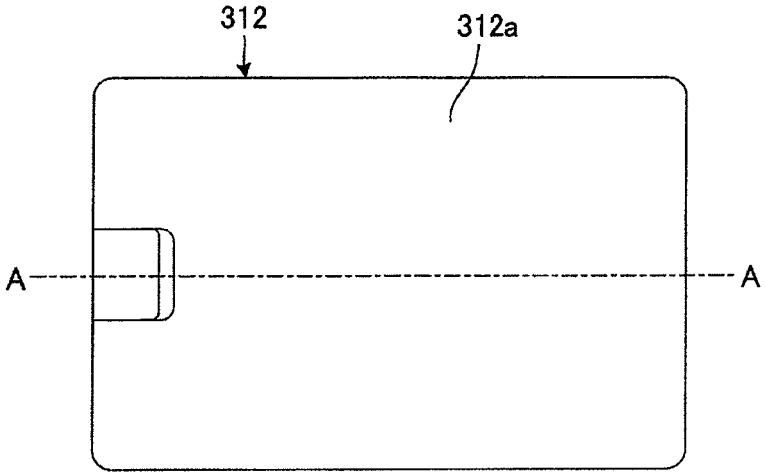
FIG. 16 is a top view of an external appearance of the electromagnetic relay shown in FIG. 12.
Figure 17:
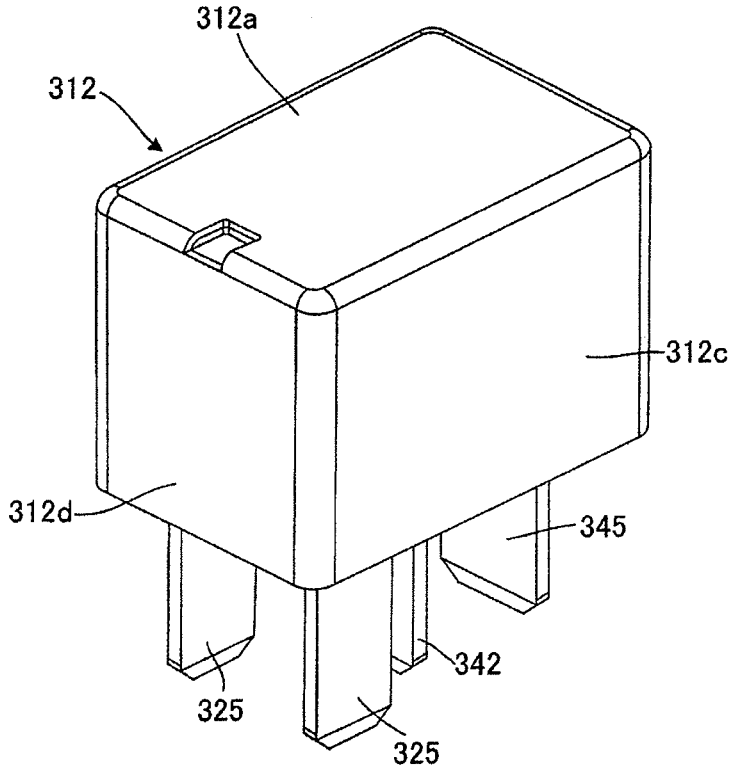
FIG. 17 is a perspective view of the external appearance of the electromagnetic relay shown in FIG. 12.
Figure 18:
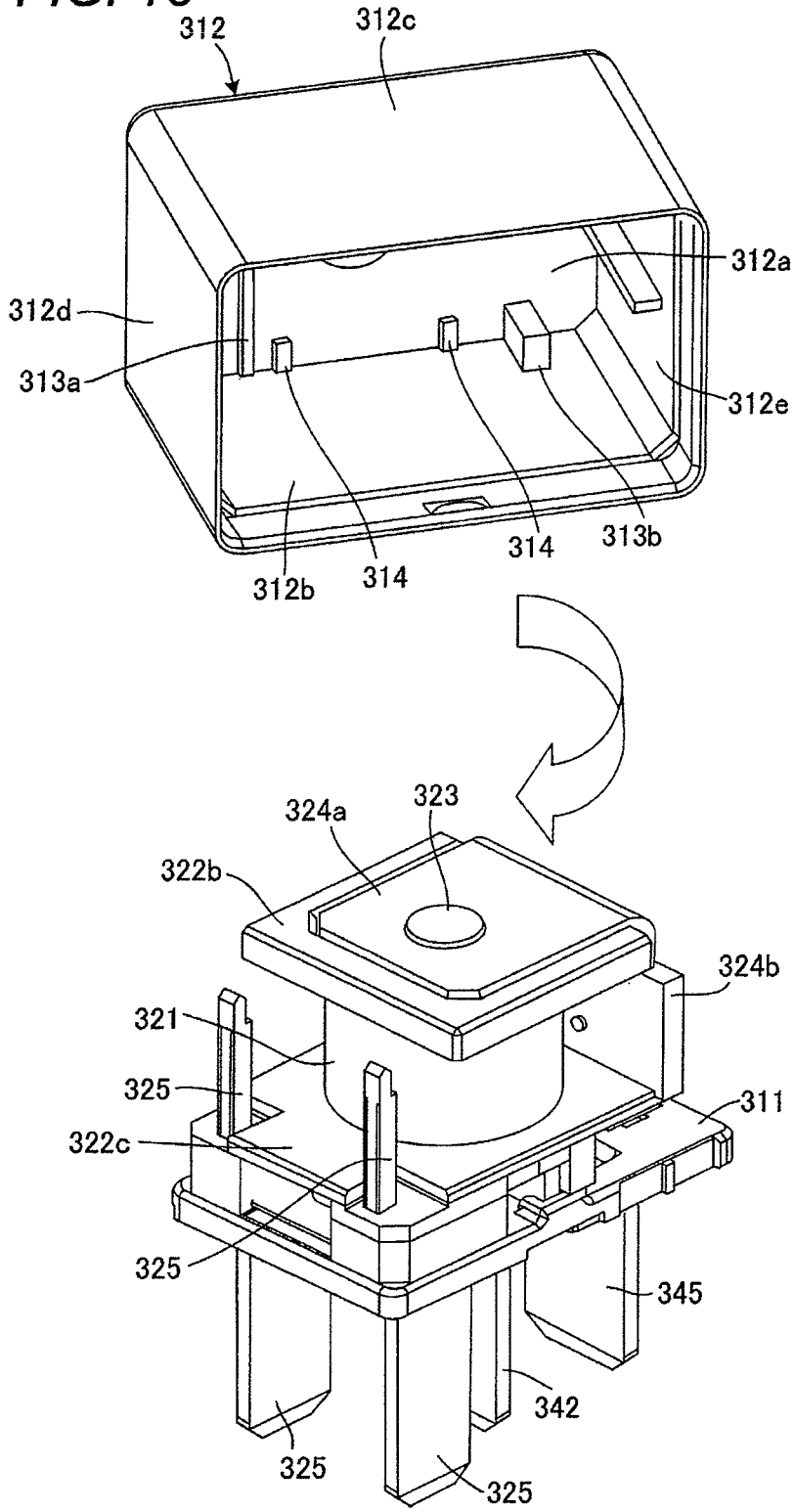
FIG. 18 is an exploded perspective view of the electromagnetic relay shown in FIG. 12.

Now, an electromagnetic relay of this exemplary embodiment will be described by referring to FIGS. 12 to 18. FIGS. 12 to 15 show sectional views of the electromagnetic relay. FIG. 16 is a top view of an external appearance. FIG. 17 is a perspective view of the external appearance. FIG. 18 is an exploded perspective view. Vertical and transverse directions in FIG. 12 are considered to be a reference, and a direction orthogonal to the vertical and transverse directions is set to a forward and rearward direction.

Figure 13:
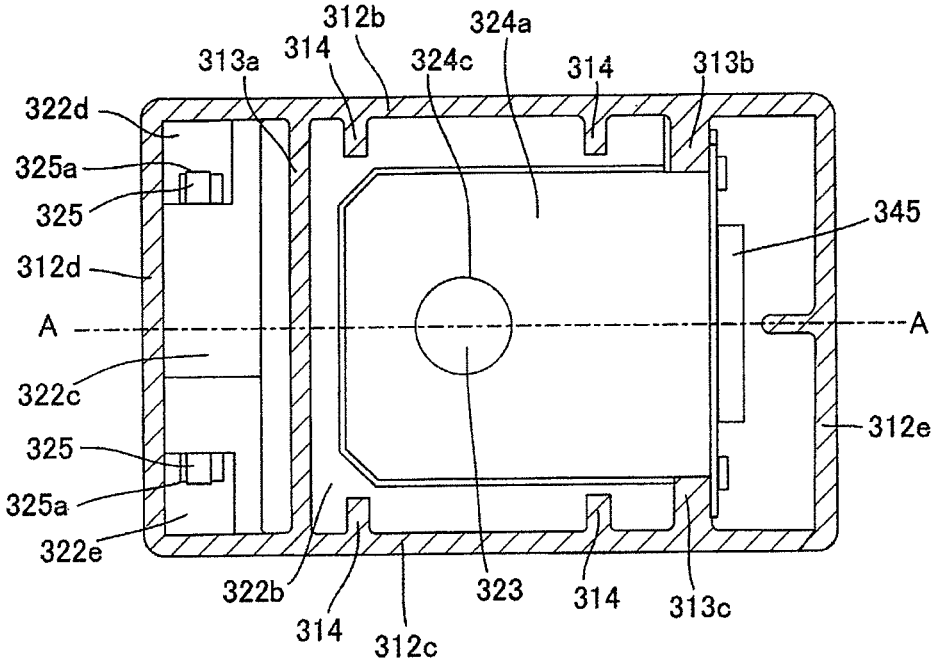
FIG. 13 is a sectional view taken along a line B-B of the electromagnetic relay shown in FIG. 12.

FIG. 12 is a sectional view taken along a line A-A in FIG. 16 which is seen from a rear part. FIG. 13 is a sectional view taken along a line B-B in FIG. 12 which is seen from an upper part. FIG. 14 is a sectional view taken along a line C-C in FIG. 12 which is seen from a left part. FIG. 15 is a sectional view taken along a line D-D in FIG. 12 which is seen from a right side.

As shown in FIGS. 12 to 18, in the electromagnetic relay of the present exemplary embodiment, in a case 301 formed in the shape of a box with an insulating material such as a resin, an electromagnet block 302, an armature 303 and a contact block 304 are accommodated. Vertical and transverse directions in FIG. 12 are considered to be a reference, and a direction orthogonal to the vertical and transverse directions is set to a forward and rearward direction, hereinafter.

The case 301 includes a substantially rectangular flat plate shaped base 311 and a substantially rectangular box shaped cover 312 having a lower surface opened and covering the base 311. The cover 312 includes a cover top surface 312*a* opposed to the base 311, cover side surfaces 312*b* and 312*c* adjacent to the cover top surface 312*a* in the forward and rearward direction and cover side surfaces 312*d* and 312*e* adjacent to the cover top surface 312*a* in the transverse direction.

The electromagnet block 302 includes a hollow cylindrical bobbin 322 on which a coil 321 is wound, an iron core 323 inserted into an inside diameter part 322*a* of the bobbin 322 and a yoke 324 forming a magnetic circuit together with the iron core 323.

The bobbin 322 is formed with an insulating material such as a resin and has rectangular collar parts 322*b* an 322*c* at both upper and lower ends in the axial direction and the coil 321 is wound on a part between the collar part 322*b* and the collar part 322*c*. Further, the collar part 322*b* is extended in the forward and rearward direction and a front end face and a rear end face abut on the cover side surfaces 312*b* and 312*c*. Further, the collar part 322*c* are extended in the transverse direction and in the forward and rearward direction, a left end face abuts on the cover side surface 312*d* and a front end face and a rear end face abut on the cover side surfaces 312*b* and 312*c*. Further, on both corners of front and rear parts in the left end of the collar part 322*c*, recessed parts 322*d* and 322*e* are formed. On bottom surfaces of the recessed parts 322*d* and 322*e*, insert holes 325*a* are opened into which a pair of coil terminals 325 are inserted to which ends of the coil 321 are respectively connected. The coil terminals 325 are formed with an electrically conductive material such as copper in the shape of a long plate long in the vertical direction and the ends of the coil 321 are wound on upper ends thereof and connected by solder or the like. Further, the coil terminals 325 are formed integrally with the bobbin 322.

The iron core 323 is formed in a long cylindrical shape and has a collar part 323*a* formed in a lower end and the collar part 323*a* is fitted to a circular recessed part 322*f* formed at a substantially central part of the collar part 322*c* of the bobbin 322.

The yoke 324 is formed substantially in the shape of L with a magnetic material by one piece 324*a* and the other piece 324*b* extended downward from a right end of the one piece 324*a*. Then, the one piece 324*a* is fitted to a substantially rectangular cut out part 322*g* formed on an upper surface of the collar part 322*b* of the bobbin 322 and has an insert hole 324*c* formed and an upper end part of the iron core 323 is inserted into the insert hole 324*c*. Further, the other piece 324*b* is formed along a right end of the bobbin 322 and the other piece 342*b* abuts on a right end face of the collar part 322*c*. Further, the other piece 324*b* has a width in the forward and rearward direction larger than that of the one piece 324*a*. A front end face and a rear end face of the other piece 342*b* abut on the cover side surfaces 312*b* and 312*c*.

The armature 303 is formed in the shape of a long flat plate with a magnetic material and arranged so as to be opposed to the collar part 323*a* of the iron core 323. Further, an upper surface of a right end of the armature 303 abuts on a lower surface of the other piece 324*b* of the yoke 324.

The contact block 304 includes a contact part 340, a fixed contact terminal 342, a movable contact plate 344, a movable contact terminal 345 and a fixed contact plate 347.

The contact part 340 includes fixed contacts 341 and 346 and a movable contact part 343 formed so as to freely contact and be separated from the fixed contacts 341 and 346 in accordance with an operation of turning on/off a current to the coil 321.

Further, the fixed contact 341 is provided in the fixed contact terminal 342 and the fixed contact 346 is provided in the fixed contact plate 347. Then, the movable contact part 343 including movable contacts 343*a* and 343*b* is provided in the movable contact plate 344. Further, the movable contacts 343*a* and 343*b* are arranged at opposed positions with the movable contact plate 344 sandwiched between them. Further, the movable contact plate 344 is connected to the movable contact terminal 345.

Further, on a lower surface of the collar part 322*c* of the bobbin 322, at both corners of front and rear parts of the left end thereof, substantially rectangular shaped structures 322*h* and 322*i* are formed. In a space 322*j* formed between the structures 322*h* and 322*i*, the contact part 340 is arranged. Lower surfaces of the structures 322*h* and 322*i* respectively abut on the base 311. Further, left surfaces of the structures 322*h* and 322*i* respectively abut on the cover side surface 312*d*.

The fixed contact terminal 342 is formed substantially in the shape of L with an electrically conductive material such as copper by a long flat plate shaped terminal part 342*a* long in the vertical direction and an extending part 342*b* extended leftward from an upper end of the terminal part 342*a*. In the vicinity of an end of the extending part 342*b*, the fixed contact 341 is provided. Further, the coil terminals 325 are formed so as to pass through the structures 322*h* and 322*i* in the vertical direction.

The fixed contact plate 347 is formed in the shape of a flat plate with an electrically conductive material such as copper and the fixed contact 346 is provided at a position opposed to the fixed contact 341 in the vertical direction. In the electromagnetic relay of the present exemplary embodiment, the fixed contact plate 347 has no contact terminal to be connected to an external part of the case 301.

The movable contact plate 344 is formed substantially in the shape of L with an electrically conductive material such as copper by a leaf spring shaped operating piece 344*a* long in the transverse direction and a fixed piece 344*b* extended upward from a right end of the operating piece 344*a*. Then, on an upper surface of the operating piece 344*a*, the armature 303 is fixed. On an upper surface of the left end of the operating piece 344*a*, the movable contact 343*a* is provided at a position opposed to the fixed contact 341. Further, on a lower surface of the left end of the operating piece 344*a*, the movable contact 343*b* is provided at a position opposed to the fixed contact 346.

Further, the fixed piece 344*b* is provided between the other piece 324*b* of the yoke 324 and the movable contact terminal 345 and fixed to an upper end side of the movable contact terminal 345 by caulking.

The movable contact terminal 45 is formed in the shape of a vertically long plate with an electrically conductive material such as copper.

On the base 311, insert holes (not shown in the drawing) are formed into which the terminal part 342*a* of the fixed contact terminal 342 and the movable contact terminal 345 and the one pair of coil terminals 325 are respectively inserted.

Then, on the cover top surface 312*a*, ribs 313*a*, 313*b*, 313*c* and positioning ribs 314 are formed.

The rib 313*a* is located at a position opposed to the collar part 322*b* in a part nearer to a left side than to the cut out part 322*g* formed in the collar part 322*b* of the bobbin 322 and formed with a wall body extended in the forward and rearward direction from a front end to a rear end of the cover top surface 312*a*. The rib 313*a* abuts on an upper surface of the collar part 322*b*.

The ribs 313*b* and 313*c* are formed with substantially rectangular wall bodies so as to bury from an upper part a width difference of the one piece 324*a* and the other piece 324*b* of the yoke 324. Further, the ribs 313*b* and 313*c* abut on the one piece 324*a* and the other piece 324*b* and a right end face of the collar part 322*b* of the bobbin 322.

The positioning ribs 314 are formed in the shapes of protrusions protruding inward the case 301 at two position formed from a front end of the cover top surface 312*a* between the rib 313*a* and the rib 313*b* and at two positions formed from a rear end of the cover top surface 312*a* between the rib 313*a* and the rib 313*c* in the positions opposed to the collar part 322*b* of the bobbin 322 and respectively abut on the upper surface of the collar part 322*b*.

In the electromagnetic relay of the present exemplary embodiment having the above-described structure, when an electric current is supplied to the coil 321, the iron core 323 is magnetized so that the armature 303 is attracted to and abut on the collar part 323*a* of the iron core 323. In accordance therewith, the end of the operating piece 344*a* of the movable contact plate 344 on which the armature 303 is provided is displaced upward and the movable contact 343*a* provided at the end abuts on the fixed contact 341, so that the movable contact terminal 345 is electrically conducted to the fixed contact terminal 342.

Further, when the supply of the electric current to the coil 321 is interrupted, the iron core 323 is demagnetized, the armature 303 is separated from the collar part 323*a* of the iron core 323 by an elastic operation of the movable contact plate 344 and the end of the operating piece 344*a* of the movable contact plate 344 is displaced downward. In accordance therewith, the movable contact 343*a* provided at the end of the operating piece 344*a* is separated from the fixed contact 341, so that the movable contact terminal 345 is electrically disconnected from the fixed contact terminal 342.

Further, when the electric current is supplied to the coil 321, temperature of a part in the vicinity of the coil 321 rises by setting the coil 321 as a heat generation source. On the contrary, since the terminal part 342*a* of the fixed contact terminal 342 and the movable contact terminal 345 protrude from the lower surface of the base 311, the temperature of the contact part 340 is liable to receive an influence of ambient temperature outside the case 301. When the ambient temperature is low, the temperature of the contact part 340 falls. Then, when air heated by the coil 321 comes into contact with the contact part 340 at the low temperature, a vapor condensation is generated in the contact part 340. Further, when the ambient temperature is a freezing point or lower, there is a fear that a failure of electric conduction may possibly occur due to a freeze.

Figure 19:
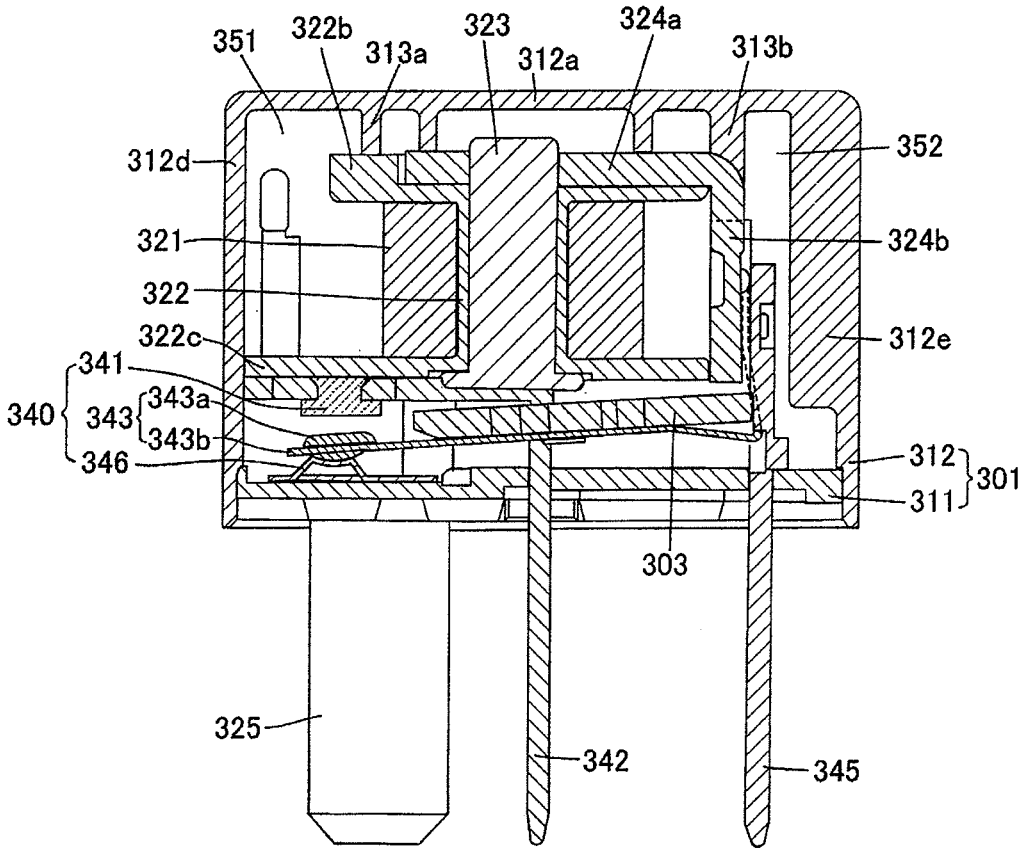
FIG. 19 is a sectional view taken along a line A-A which shows a coil space and a contact space of the electromagnetic relay shown in FIG. 12.

Thus, in the electromagnetic relay of the present exemplary embodiment, in the above-described structure, a coil space 351 where the coil 321 is arranged is isolated from a contact space 352 where the contact part 340 is arranged. FIG. 19 shows a positional relation between the coil space 351 where the coil 321 is arranged and the contact space 352 where the contact part 340 is arranged. In FIG. 19, in order to clearly show the coil space 351 and the contact space 352, outlines of the coil space 351 and the contact space 352 are shown by thick lines.

The coil space 351 where the coil 321 is arranged mainly means a space between the collar part 322*b* and the collar part 322*c* of the bobbin 322. Specifically, the coil space 351 is a space where the coil 321 is surrounded by the collar parts 322*b* and 322*c* of the bobbin 322, the cover top surface 312*a* in the left side from the rib 313*a*, the cover side surfaces 312*b*, 312*c* and 312*d* and the other piece 324*b* of the yoke 324.

Further, the contact space 352 where the contact part 340 is arranged means a space excluding the coil space 351 where the coil 321 is arranged in the space of the case 301 and is a substantially U shaped space having, as an outline, the cover top surface 312*a*, the cover side surfaces 312*b*, 312*c* and 312*e* and the base 311. A specific structure of the contact space 352 includes a space between the base 311 and the collar part 322*c* of the bobbin 322, a space between the cover side surface 312*e* and the other piece 324*b* of the yoke 324 and a space between the cover top surface 312*a* in the right side from the rib 313*a* and the collar part 322*b* of the bobbin 322 and the one piece 324*a* of the yoke 324.

In a specific structure that insulates the oil space 351 from the contact space 352, the collar parts 322*b* and 322*c* of the bobbin 322 are extended in the forward and rearward direction and abut on the cover side surfaces 312*b* and 312*c* to prevent the coil space 351 from being continuous to an upper part and a lower part of the contact space 352 along the cover side surfaces 312*b* and 312*c*. Further, the rib 313*a* provided in the cover top surface 312*a* abuts on the collar part 322*b* to prevent the coil space 351 from being continuous to the upper part of the contact space 352 along the cover top surface 312*a*. Further, the ribs 313*b* and 313*c* provided on the cover top surface 312*a* abut on the right end face of the collar part 322*b* and the yoke 324 to prevent the coil space 351 from being continuous to a right part of the contact space 352 from a clearance between the collar part 322*b* and the other piece 342*b*. Further, the front end face and the rear end face of the other piece 324*b* of the yoke 324 abut on the cover side surfaces 312*b* and 312*c* to prevent the space 351 from being continuous to the right part of the space 352 along the cover side surfaces 312*b* and 312*c*.

Further, the left end face of the collar part 322*c* of the bobbin 322 abuts on the cover side surface 312*d* and the right end face of the collar part 322*c* abuts on the other piece 324*b* of the yoke 324 to prevent the coil space 351 from being continuous to a lower part of the contact space 352 along the cover side surface 312*d* and a left surface of the other piece 324*b*.

Further, the lower surfaces of the structures 322*h* and 322*i* formed on the lower surface of the collar part 322*c* of the bobbin 322 respectively abut on the base 311 and the left surfaces of the structures 322*h* and 322*i* respectively abut on the cover side surface 312*d* to prevent the coil space 351 from being continuous to the lower part of the contact space 352 along the cover side surface 312 and the base 311. Further, a front end face of the structure 322*h* abuts on the cover side surface 312*b* and a rear end face of the structure 322*i* abuts on the cover side surface 312*c* to prevent the coil space 351 from being continuous to the lower part of the contact space 352 along the cover side surfaces 312*b* and 312*c*.

In the above-described structure, air of the coil space 351 heated by the coil 321 does not enter the contact space 352 where the contact part 340 is arranged. Accordingly, the temperature of the contact space 352 where the contact part 340 is arranged is substantially equal to the ambient temperature to decrease a temperature difference relative to the contact part 340. As a result, even when the ambient temperature is low, a vapor condensation or freeze can be restrained from occurring in the contact part 340 and a failure of electric conduction of the contact part 340 can be prevented.

Further, in the present invention, when air of the coil space 351 where the coil 321 is arranged is isolated from the contact space 352 where the contact part 340 is arranged, parts such as a shield wall do not need to be newly added. When only the forms of the case 301, the bobbin 322 and the yoke 324 are changed by using the same parts structure as the usual electromagnetic relay, the occurrence of the vapor condensation and freeze of the contact part 340 can be easily suppressed and the failure of electric conduction of the contact part 340 can be advantageously prevented.

The present invention is described in detail by referring the specific exemplary embodiments, however, it is apparent to a person with ordinary skill in the art that various changes or modifications may be made without departing from the spirit and scope of the present invention.

This application is based on Japanese Patent Application (Application No. 2009-149159) filed on Jun. 23, 2009, Japanese Patent Application (Application No. 2009-160772) filed on Jul. 7, 2009 and Japanese Patent Application (Application No. 2009-280816) filed on Dec. 10, 2009, and contents thereof are incorporated herein as references.

DESCRIPTION OF REFERENCE SIGNS

1 Case
2 Electromagnet Block
3 Contact Block
11 Base
12 Cover
13 Partition Wall
15 Rib
21 Coil
22 Coil Bobbin
30 Contact Part
31 Fixed Contact
33 Movable Contact
201 Case
202 Main Body Part
203 Terminal for Fixed Contact
203*a* Terminal Piece
203*b* Connecting Part
204 Body
205 Base
205*a*, 205*b* Through Hole
206 Electromagnet
207 Yoke
207*a* Horizontal Part
207*b* Rising Part
207*c* Through Hole
208 Movable Spring
208*a* Operating Part
208*b* Fixed Part
208*c* Hinge Spring Part
209 Armature
209*a* Right End Part
210 Bobbin
210*a* Winding Part
210*b* Upper Jaw Part
210*c* Lower Jaw Part
210*d* Through Hole
210$c_1$ Side Wall Part
210$c_2$ Front End Part
211 Terminal for Movable Contact
211*a* Terminal Piece
212, 213 Coil Terminal
212*a*, 213*a* Terminal Piece
214 Coil
215 Iron Core
215*a* Jaw Part
220 Movable Contact
221 Fixed Contact
230 Protruding Part
301 Case
302 Electromagnet Block
303 Armature
304 Contact Block
312 Cover
313*a*, 313*b*, 313*c* Rib
321 Coil
322 Bobbin
322*b*, 322*c* Collar Part of Bobbin
323 Iron Core
324 Yoke
341 Fixed Contact
343*a* Movable Contact
351 Coil Space
352 Contact Space

The invention claimed is:

1. An electromagnetic relay comprising:
a bobbin comprising a winding part, jaw parts extending from both ends of the winding part, and a pair of opposing side wall parts;
a coil wound on the winding part of the bobbin;
an iron core attached to the bobbin;
an armature supported to be freely swung by a hinge spring and magnetically attracted to one end of the iron core by supplying a current to the coil;
a movable contact which contacts or is separated from a fixed contact in accordance with a swing movement of the armature; and
a case that accommodates the elements,
wherein the jaw part of the bobbin is formed to extend to a part in the vicinity of a side wall of the case and is interposed between the coil and the movable and fixed contacts so as to separate a first space where the coil exists from a second space where the fixed contact and the movable contact exist,
wherein the jaw part of the bobbin comprises a first jaw part surface which faces the coil; and a second jaw part surface which is opposite to the first jaw part surface and which faces the fixed contact and the movable contact; and
wherein each of the side wall parts extends from the jaw part along the axial direction of the bobbin toward the second space and has a distal end abutting on the case.

2. The electromagnetic relay according to claim 1,
wherein the jaw part of the bobbin is formed to extend to the part in the vicinity of the side wall of the case, and further extend toward the space where the movable contact and the fixed contact exist.

3. The electromagnetic relay according to claim 1,
wherein a protruding part is provided in the side wall of the case correspondingly to an extended part obtained by extending the jaw part of the bobbin to the part in the vicinity of the side wall of the case.

4. An electromagnetic relay comprising:
an electromagnet block comprising:
a bobbin on which a coil is wound;
an iron core inserted into an inside diameter part of the bobbin; and
a yoke forming a magnetic circuit together with the iron core;
a contact block comprising:
a fixed contact; and
a movable contact which freely contacts and is separated from the fixed contact in accordance with an operation of turning on/off a current to the coil; and a case that accommodates therein the electromagnet block and the contact block, inner surfaces of the case comprising a first surface and a second surface opposing the first surface, the first surface defining a first surface side of the case, and the second surface defining a second surface side of the case, the case further comprising a protruding part extending in an extending direction from the first surface toward the second surface, the protruding part comprising a base end connected to the first surface and a distal end opposite to the base end in the extending direction, wherein the electromagnet block is arranged in the first surface side of the case, the contact block is arranged in the second surface side, and the bobbin or the yoke is separated from the first surface and abuts the distal end of the protruding part of the case, whereby a space where the coil is arranged is isolated from a space where the contact block is arranged, and wherein the extending direction of the protruding part is substantially along an axial direction of the bobbin.

5. The electromagnet relay according to claim 4, wherein the bobbin and the yoke abut on a side surface of the case which connects the first surface to the second surface of the case.

6. The electromagnet relay according to claim 1, wherein the first jaw part surface faces the coil in the axial direction of the bobbin, and the second jaw part surface faces the fixed contact and the movable contact in the axial direction of the bobbin.

7. The electromagnet relay according to claim 1, wherein the first jaw part surface and the second jaw part surface extend substantially perpendicular to the axial direction of the bobbin.

8. The electromagnet relay according to claim 1, wherein the distal end of the side wall part abuts a bottom wall of the case, and wherein the second jaw part surface of the bobbin faces the bottom wall of the case in the axial direction of the bobbin, and the movable contact and the fixed contact are provided between the second jaw part surface and the bottom wall of the case.

9. The electromagnet relay according to claim 1, wherein each of the side wall parts extends from the jaw part along the axial direction of the bobbin toward the fixed contact and the movable contact.

10. An electromagnetic relay comprising:

an electromagnet block comprising:

a bobbin on which a coil is wound;

an iron core inserted into an inside diameter part of the bobbin; and a yoke forming a magnetic circuit together with the iron core;

a contact block comprising:

a fixed contact; and a movable contact which freely contacts and is separated from the fixed contact in accordance with an operation of turning on/off a current to the coil; and a case that accommodates therein the electromagnet block and the contact block, inner surfaces of the case comprising a first surface and a second surface opposing the first surface, the first surface defining a first surface side of the case, and the second surface defining a second surface side of the case, the case further comprising a protruding part extending in an extending direction from the first surface toward the second surface, the protruding part comprising a base end connected to the first surface and a distal end opposite to the base end in the extending direction, wherein the electromagnet block is arranged in the first surface side of the case, the contact block is arranged in the second surface side, and the bobbin or the yoke is separated from the first surface and abuts the distal end of the protruding part of the case, whereby a space where the coil is arranged is isolated from a space where the contact block is arranged, wherein the protruding part comprises a side surface which connects the base end to the distal end, and a distal end surface which is connected to the side surface and which defines the distal end, wherein the distal end surface abuts the bobbin or the yoke.

11. The electromagnet relay according to claim 10, wherein the bobbin and the yoke abut on a side surface of the case which connects the first surface to the second surface of the case.

* * * * *